US005600341A

United States Patent [19]

Thill et al.

[11] Patent Number: 5,600,341

[45] Date of Patent: Feb. 4, 1997

[54] DUAL FUNCTION ANTENNA STRUCTURE AND A PORTABLE RADIO HAVING SAME

[75] Inventors: Kevin M. Thill, Kenosha, Wis.; Christopher N. Kurby, Elmhurst, Ill.

[73] Assignee: Motorola, Inc., Schaumburg, Ill.

[21] Appl. No.: 517,490

[22] Filed: Aug. 21, 1995

[51] Int. Cl.[6] ..... H01Q 1/24; H01Q 1/36

[52] U.S. Cl. ..... 343/895; 343/702

[58] Field of Search ..... 343/895, 725, 343/726, 728, 729, 702, 722, 856, 857, 858; H01Q 1/24, 1/36

[56] References Cited

U.S. PATENT DOCUMENTS

| | | | |
|---|---|---|---|
| 2,184,729 | 12/1939 | Bailey | 343/830 |
| 4,352,109 | 9/1982 | Reynolds et al. | 343/792 |
| 4,410,893 | 10/1983 | Griffee | 343/792 |
| 4,433,336 | 2/1984 | Carr | 343/728 |
| 4,509,056 | 4/1985 | Ploussios | 343/791 |
| 5,274,388 | 12/1993 | Ishizaki et al. | 343/895 |

FOREIGN PATENT DOCUMENTS

| | | | |
|---|---|---|---|
| 924145 | 4/1963 | United Kingdom | 343/895 |

OTHER PUBLICATIONS

S. Egashira et al., "A Design of AM/FM Mobile Telephone Triband Antenna", *IEEE Transactions on Antennas and Propagation,* vol. 42, No. 4, Apr. 1994, pp. 538–545.

*Primary Examiner*—Hoanganh T. Le
*Attorney, Agent, or Firm*—Daniel W. Juffernbruch

[57] ABSTRACT

A dual function antenna structure transceives in first and second modes. A first feed (120) feeds a primary antenna element (110) for operation in the first mode. A second feed (140) couples via a coupling element (130) to a portion of the first feed (120) or the primary antenna element (110) to realize a secondary antenna element. In a portable radio, dual function operation is thus possible by a compact structure by the first and second feeds (120, 140).

22 Claims, 2 Drawing Sheets

DUAL FUNCTION ANTENNA STRUCTURE AND A PORTABLE RADIO HAVING SAME

BACKGROUND OF THE INVENTION

1. Technical Field of the Invention

The present invention relates to a dual function antenna structure and, more particularly, relates to a primary antenna element which resembles a secondary antenna element when operating in a second mode.

2. Description of the Related Art

Portable electronic radio equipment are typically desired for their small size and portable convenience. Typically, a single small antenna structure, such as a telescoping dipole or monopole antenna, is common. Nevertheless, these and other known antennas accommodate only one mode of operation. For example, these antennas are not optimized to resonate at two different radio frequencies.

Furthermore, these antennas accommodate radio frequency energy of only one type of polarization. For example, the telescoping monopole antenna of a typical cellular radiotelephone today accommodates only linearly polarized radio frequency energy. Compact antenna structures capable of providing a dual function of selected linearly polarized and circularly polarized radio frequency energy are unknown in the art.

DETAILED DESCRIPTION OF THE PREFERRED EMBODIMENTS

Figure 1:
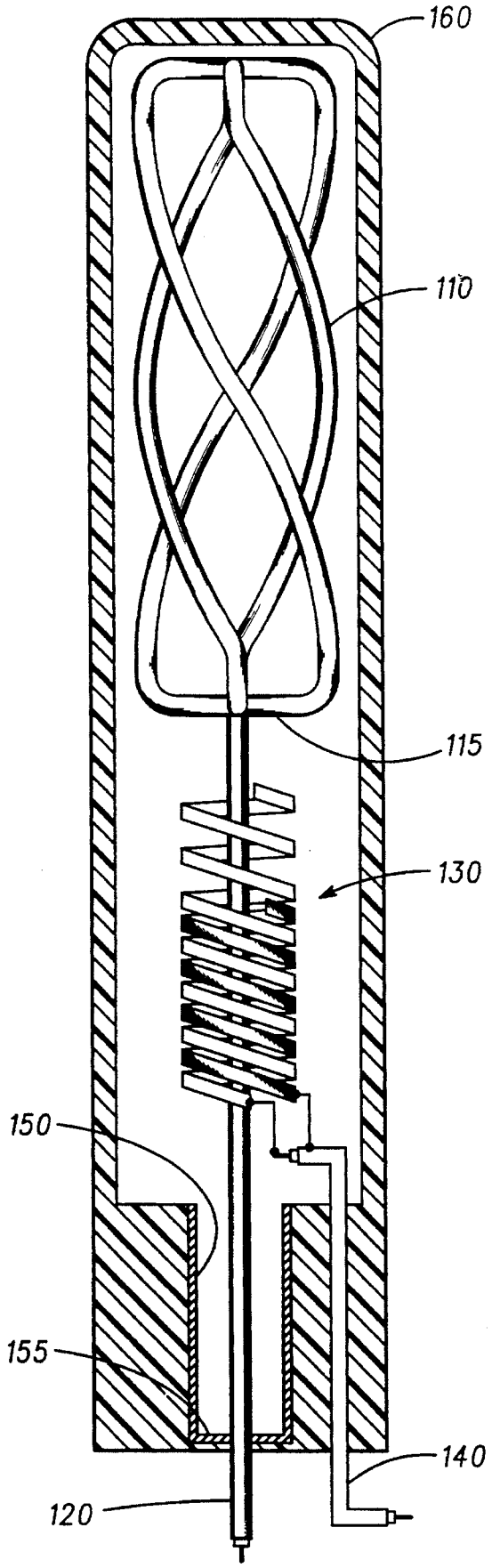
FIG. 1 illustrates a side view of a dual function antenna structure of an embodiment.

FIG. 1 illustrates a dual function antenna structure according to a first embodiment of the present invention. A primary antenna structure is provided by a primary antenna element 110 and a first feed 120. A quadrifilar helix antenna element preferably forms the primary antenna element 110. The primary antenna element 110 resonates at a frequency of the first feed 120 and is thus fed by the first feed 120. A secondary antenna element is fed using a two arm helix as a coupling element 130 between the first feed 120 and a second feed 140. A secondary antenna element is formed by the primary antenna element 110 and portions of the first feed 120, and the secondary antenna element resonates at a frequency of the second feed 140. A compact antenna structure capable of providing a dual function is thus provided. Furthermore, the quadrifilar helix of the primary antenna element functionally resembles both a linearly polarized antenna structure and a circularly polarized antenna structure.

When more efficient operation is desired, a choke 150 can be used to prevent energy from the second feed 140 from traveling downward below the coupling element 130 and to improve pattern characteristics of the antenna. The position of the choke 150 also adjusts the electrical length or frequency characteristics of the portion of the first feed 120 above the choke 150. The electrical length or frequency characteristic of the portion of the first feed 120 and primary antenna element 110 above the choke 150 is approximately one-half the wavelength of the radio frequency energy in the second mode. Thus, should the electrical length of the second mode need to be adjusted, the location of the choke is selected to trim or adjust the electrical length of the secondary antenna element in the second mode.

The choke 150 preferably is approximately a quarter-wavelength choke having a shorted end 155 and metalized inner surfaces. The choke can have an electrical length an odd multiple of approximately a quarter-wavelength of the radio frequency energy in the second mode. Thus the choke approximates a quarter-wave transmission line with a shorted end.

The primary antenna element 110, first feed 120, second feed 140 and coupling element 130 preferably are housed in a radome 160 to form the antenna structure. The radome 160 is an enclosed tube of dielectric material which protects the antenna elements and feeds from the external environment.

The quadrifilar helix of the primary antenna element 110 of the first embodiment is preferably constructed using semi-rigid metal coaxial material. The semi-rigid metal coaxial material has a metallic outer conductor insulated by a dielectric from a metallic center conductor. The first feed 120 is also preferably constructed of this semi-rigid metal coaxial material. The energy of the primary antenna element 110 travels inside the semi-rigid metal coaxial material of the first feed 120 on first and second surfaces. The first and second surfaces inside of the semi-rigid metal coaxial material are, respectively, the metallic center conductor and the inside skin of the metallic outer conductor. The metallic outer conductor of the semi-rigid coaxial material has a third surface. The third surface is the outside skin of the metallic outer conductor.

At a short point 115, the third surface on the outside of the semi-rigid coaxial material of the first feed 120 and the four arms of the quadrifilar helix of the primary antenna element 110 are shorted. The coupling element 130 couples energy from the second feed 140 to the third surface of the outside skin of the metallic outer conductor of the first feed 120.

When the antenna structure operates in the second mode through the second feed 140, the coupling element 130 couples energy on the outer conductor of the first feed 120 and the primary antenna element 110. These coaxial inner and outer conductor connections are preferred in this embodiment; nevertheless, other constructions are possible as will be explained further with reference to other embodiments. A secondary antenna element capable of transceiving linearly polarized radio frequency energy is thus achieved by the outer surfaces of the first feed 120 and the quadrifilar helix of the primary antenna element 110. The quadrifilar helix of the primary antenna element transceives circularly polarized radio frequency energy. Thus, the first embodiment of FIG. 1 performs the dual functions of transceiving circularly polarized radio frequency energy in one mode and linearly polarized radio frequency energy in another mode.

A dual function antenna structure is desired for a compact dual mode portable radio. For example, terrestrial or land-based cellular radio systems typically use linearly-polarized radio energy. Portable satellite radios, on the other hand, typically need to employ circularly polarized antennas. Circularly polarized antennas have a better gain pattern for receiving and transmitting energy towards the zenith to sources in outer space rather than linearly polarized antennas. Linearly-polarized antennas have a better gain pattern for transmitting and receiving energy towards the horizon to terrestrial base stations. A single antenna structure capable of operating in both a linearly-polarized mode and a circularly-polarized mode is thus provided by the present invention. Compact portable, dual mode satellite and terrestrial radio receivers are thus possible using a single antenna structure by the present invention.

The coupling element 130 preferably is made of a two arm coupling helix. The two arm coupling helix has a hot arm coil and a ground arm coil of different dimensions or lengths to couple energy of the second feed 140 to the first feed 120. The two arm coupling helix of the coupling element 130 allows a matched impedance input for the second feed 140. The two arm coupling helix also improves antenna pattern characteristics by eliminating flow of induced currents on a housing of a radio below the two coils. A higher gain antenna is thus achieved in the second mode for better communications while current drain on the battery of a portable radio is reduced.

The two coils of the two arm coupling helix should be wrapped around the first feed 120 without touching, and a dielectric insulator therebetween such as a dielectric or cardboard cylinder is preferred. The two coils are preferably flat copper microstrip conductors of roughly 0.05 millimeters (two thousandths of an inch) thick and roughly 1.778 millimeters (0.070 inches) wide. Alternatively, the two coils could be freestanding in space or encapsulated within a plastic molding. The cylinder preferably has as small as practical a diameter for compact realization and preferably has a diameter of less than one tenth of a wavelength of a signal to be transceived. The two coils could alternatively be placed next to rather than wrapped around the first feed 120.

As an example, in a terrestrial cellular radiotelephone system, a 920 MHz frequency signal may be desired in the second mode. Preferably, the ground arm should be longer than the hot arm by a ratio of 2.5 to 2.0 of the coupling element 130. Using an approximately 8.128 millimeters (0.32 inches) diameter cylinder, the hot arm coil has a coiled axial length of approximately of 20.955 millimeters (0.825 inches) and the ground arm coil has a coiled axial length of approximately 30.099 millimeters (1.185 inches) and the coils are pitched at roughly a 15° angle. Because the two coils are pitched to allow them to be twisted around the cylinder, the circumference of the cylinder will be slightly smaller than the circumference of one turn of the coils. Thus the hot arm coil has approximately 3.25 turns and the ground arm coil has approximately 5.5 turns. The two coils are preferably interleaved with one another as illustrated. The two coils could preferably be offset such that the shorter coil is not completely, or at all, interleaved with the longer of the coils.

Figure 2:
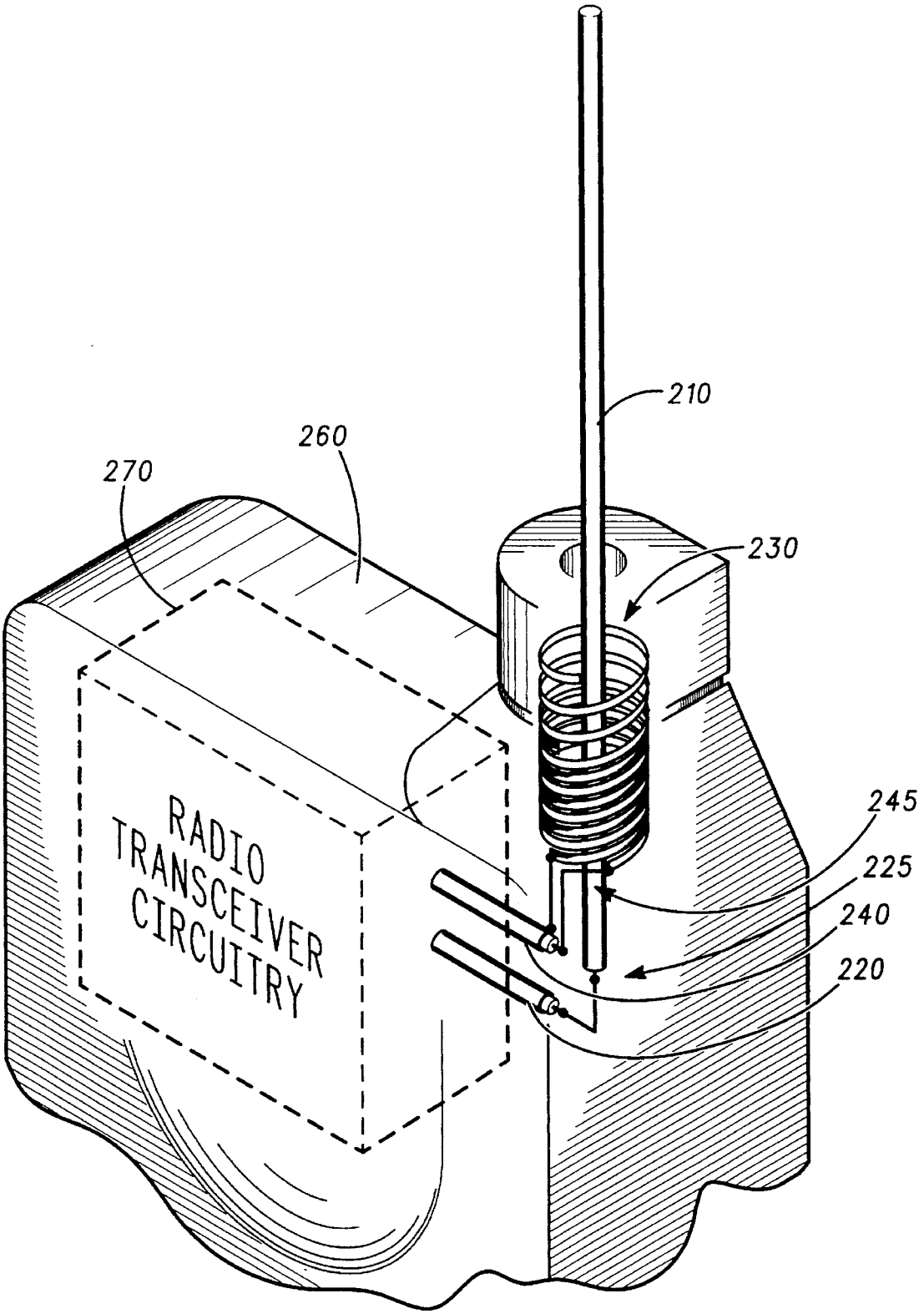
FIG. 2 illustrates a perspective view of a portable radio with a dual function antenna structure according to another embodiment.

FIG. 2 illustrates a portable radio 260 having a compact single antenna structure and dual function capability. A first feed 220 connects radio circuitry 270 to a primary antenna element 210 at a first node 225. A second feed 240 connects radio circuitry 270 to a coupling element 230 at a second node 245. In the alternative embodiment of FIG. 2, the second feed 240 connects via the coupling element 230 to the primary antenna element 210 rather than the first feed 220. In many instances, the choice of connection of the second feed to the first feed and/or the primary antenna element is inconsequential. The choice of whether to connect the second feed via a coupling element to the first feed or, alternatively, to the primary antenna element depends, in part, on the type of antenna element and on the desired respective electrical lengths of the primary antenna element and the secondary antenna element to be realized using portions of the primary antenna and/or the first feed.

In the alternative embodiment of FIG. 2, a monopole antenna element is used for the primary antenna element 210 as opposed to the quadrifilar helix antenna element of the first embodiment of FIG. 1. This alternative embodiment of FIG. 2 thus provides a dual function antenna element where both the first and second modes are linearly polarized.

No choke is illustrated in the alternative embodiment of FIG. 2. The dual function antenna structure of FIG. 2 will operate sufficiently without the choke. The portable radio 260 will operate sufficiently without a choke when loss of energy can be tolerated due to currents induced on the radio. Also, without the choke, the first feed will direct some of the energy on the antenna into the radio circuitry 270.

Although the invention has been described and illustrated in the above description and drawings, it is understood that this description is by example only and that numerous changes and modifications can be made by those skilled in the art without departing from the true spirit and scope of the invention. For example, different types of primary antenna elements may be employed, such as a dipole or an crossed-loop without the twist of a quadrifilar helix. Further, the coupling element can be constructed using structures other than the two arm coupling helix such as, for example, a single helix fed from one end. Multiple function antenna structures having three or more modes may also be accommodated by employing three or more feeds and a plurality of respective coupling elements. Although the antenna structure realizes a compact portable radio, the antenna structure can be used with mobile radios or fixed location radios.

What is claimed is:

1. A dual function antenna structure for transceiving first and second signals of different frequencies, comprising:

a primary antenna structure including a primary antenna element capable of transceiving the first signal in a first mode; and a first feed operatively coupled to the primary antenna element to feed therein the first signal to be transceived by the primary antenna element in the first mode;

a second feed to feed therein the second signal to be transceived in a second mode; and a coupling element operatively connected between the primary antenna structure and the second feed disposed to electromagnetically couple directly between the primary antenna structure and the second feed and having characteristics sufficient to cause the primary antenna structure to form a secondary antenna element for transceiving the second signal by the primary antenna structure in the second mode at a different frequency than the first signal in the first mode.

2. A dual function antenna structure according to claim 1, wherein the coupling element couples the second feed to a portion of the first feed of the primary antenna structure.

3. A dual function antenna structure according to claim 1, wherein the coupling element couples the second feed to the primary antenna element of the primary antenna structure.

4. A dual function antenna structure according to claim 1, wherein the secondary antenna element is a linearly polarized antenna element for transceiving a linearly polarized second signal.

5. A dual function antenna structure according to claim 4, wherein the primary antenna element comprises a circularly polarized antenna element.

6. A dual function antenna structure according to claim 5, wherein the coupling element couples the second feed to a portion of the first feed of the primary antenna structure; and wherein the circularly polarized antenna element comprises a quadrifilar helix antenna element.

7. A dual function antenna structure according to claim 4, wherein the primary antenna element comprises a linearly polarized antenna element.

8. A dual function antenna structure according to claim 7, wherein the linearly polarized antenna element comprises a monopole antenna element.

9. A dual function antenna structure according to claim 1, wherein the coupling element comprises at least one coil for electromagnetically coupling directly between the second feed and the primary antenna structure.

10. A dual function antenna structure according to claim 9, wherein the primary antenna structure extends along a first axis; and wherein the coil of the two arm structure of the coupling element extends along a second axis parallel to the first axis.

11. A dual function antenna structure according to claim 1, wherein the coupling element comprises a two arm structure for electromagnetically coupling directly between the second feed and the primary antenna structure.

12. A dual function antenna structure according to claim 11, wherein the two arm structure forms a helix for coupling to the primary antenna structure.

13. A dual function antenna structure according to claim 11, wherein the a second feed has at least a hot conductor and a ground conductor to feed the second signal to be transceived in the second mode; and wherein the coupling element comprises a hot arm coil disposed in proximity to a portion of the primary antenna structure for coupling the hot conductor thereto; and a ground arm coil disposed in proximity to the portion of the primary antenna structure for coupling the ground conductor thereto.

14. A dual function antenna structure according to claim 13, wherein the primary antenna structure extends along a first axis; and wherein the two arm structure of the coupling element extends along a second axis parallel to the first axis.

15. A dual function antenna structure according to claim 13, wherein the hot arm coil and the ground arm coil have different lengths.

16. A dual function antenna structure according to claim 13, wherein respective lengths of the hot arm coil and the ground arm coil are sufficient to cause the antenna structure to be matched to an impedance of the hot and ground feeds.

17. A dual function antenna structure according to claim 13, wherein the hot arm coil and the ground arm coil are interleaved with one another.

18. A dual function antenna according to claim 1, wherein said first feed comprises a choke capable of choking at a wavelength of the second signal.

19. A dual function antenna structure according to claim 18, wherein the second signal feed is coupled to the first signal feed of the primary antenna structure by the coupling element at a location between the primary antenna element and the choke.

20. A dual function antenna structure according to claim 18, wherein the choke comprises a transmission line having a shorted end and wherein the transmission line having a shorted end has an electrical length an odd integral multiple of approximately one-quarter the second wavelength.

21. A dual function antenna structure according to claim 1, further comprising radio circuitry capable of operating in the first mode and in the second mode, a first mode output of the radio circuitry coupled to the first feed and a second mode output of the radio circuitry coupled to the second feed.

22. A portable radio having a dual function antenna structure for transceiving first and second signals of different frequencies, comprising:

a primary antenna structure including a primary antenna element capable of transceiving the first signal in a first mode; and a first feed operatively coupled to the primary antenna element to feed therein the first signal to be transceived by the primary antenna element in the first mode;

a second feed to feed therein the second signal to be transceived in the second mode;

a coupling element operatively connected between the primary antenna structure and the second feed disposed to electromagnetically couple directly between the primary antenna structure and the second feed and having characteristics sufficient to cause the primary antenna structure to form a secondary antenna element for transceiving the second signal by the primary antenna structure in the second mode at a different frequency than the first signal in the first mode; and radio circuitry capable of operating in the first mode and in the second mode, a first mode output of the radio circuitry coupled to the first feed and a second mode output of the radio circuitry coupled to the second feed.

* * * * *